US005682686A

United States Patent [19]

Condini

[11] Patent Number: 5,682,686

[45] Date of Patent: Nov. 4, 1997

[54] COMFORT INNER BOOT FOR A SKI BOOT

[75] Inventor: Alessandro Condini, Villazzano, Italy

[73] Assignee: Lange International S.A., Switzerland

[21] Appl. No.: 513,157

[22] Filed: Aug. 9, 1995

[30] Foreign Application Priority Data

Sep. 22, 1994 [CH] Switzerland ..... 2 886/94

[51] Int. Cl.[6] ..... A43B 7/20; A43B 5/04

[52] U.S. Cl. ..... 36/89; 36/10; 36/93; 36/117.6

[58] Field of Search ..... 36/88, 10, 93, 36/117.6, 55, 89, 92

[56] References Cited

U.S. PATENT DOCUMENTS

| | | | |
|---|---|---|---|
| 387,119 | 7/1888 | Stevens | 36/89 |
| 642,474 | 1/1900 | Moser | 36/3 A |
| 757,816 | 4/1904 | Krieger | 36/89 |
| 3,006,084 | 10/1961 | Le Compte | 36/3 A X |
| 3,025,614 | 3/1962 | Bingham, Jr. | 36/3 R |
| 3,659,361 | 5/1972 | White, Sr. | 36/89 |
| 3,888,242 | 6/1975 | Harris et al. | 36/141 |
| 4,095,355 | 6/1978 | Annovi | 36/3 A |
| 4,920,666 | 5/1990 | Marega | 36/10 X |
| 5,050,319 | 9/1991 | Perotto et al. | 36/117.6 |
| 5,067,257 | 11/1991 | Coomer | 36/117.6 |
| 5,339,545 | 8/1994 | Paris | 36/117.6 |

FOREIGN PATENT DOCUMENTS

| | | | |
|---|---|---|---|
| 351396 | 1/1990 | European Pat. Off. | 36/55 |
| 0 568 825 A1 | 11/1993 | European Pat. Off. . | |
| 2 336 892 | 7/1977 | France . | |
| 2507537 | 12/1982 | France | 36/55 |
| 2 594 304 | 8/1987 | France . | |
| 17228 | 10/1906 | United Kingdom | 36/3 R |

OTHER PUBLICATIONS

International Search Report No. CH 288694 dated May 16, 1995.

*Primary Examiner*—Ted Kavanaugh

*Attorney, Agent, or Firm*—Kane, Dalsimer, Sullivan, Kurucz, Levy, Eisele and Richard, LLP

[57] ABSTRACT

The comfort inner boot for a ski boot comprises a plastic boot leg (2, 6), the inner face of which is provided with studs (12), of which the height and at least one of the parameters: mean cross section, distribution density, and nature of the material vary according to the zone in question, in such a way that the boot leg has zones of different thickness and compressibility. The studs are preferably covered with a foam (13), the effect of which, combined with the spaces made between the studs (12), makes it possible to provide the anatomical shape of the inner boot, its comfort and its technical features.

11 Claims, 3 Drawing Sheets

COMFORT INNER BOOT FOR A SKI BOOT

FIELD OF THE INVENTION

The subject matter of the present invention is a comfort inner boot for a ski boot, comprising an upper surrounding the foot and a plastic boot leg, which is intended at least partially to surround the lower leg and the inner face of which is provided with projections distributed over at least a part of its surface.

An inner boot for a ski boot should fulfill a plurality of functions, namely matching of the shell to the shape of the foot, thermal insulation, comfort and function interface between the shell and the foot, for transmission of information and control between the ski and the foot, and vice versa. These functions are largely antinomical, considering that morphological matching and comfort assume flexibility and compressibility, whereas the interface function assumes close and rigid contact.

Essentially two methods of manufacturing inner boots are known: molding and foam coupling. Molding makes it possible to obtain the desired anatomical shape. The comfort obtained is mediocre. As regards the interface function, it is satisfied very poorly because of the uniform compressibility of the inner boot, that is to say the excessive compressibility in bearing zones used, in particular, for transmitting reactions of the ski and control from the foot and the leg to the ski.

This technique has been improved by adding, by overmolding, a comfort foam but, despite the substantial increase in cost price, such an inner boot still does not fulfill the desired conditions.

Coupling foams with different qualities makes it possible to obtain inner boots with approximately anatomical shape and good comfort. The technical feature, that is to say the interface function, may be considered as being mediocre to good, but the cost of such inner boots is relatively high.

PRIOR ART

Patent FR 2,690,814 describes a comfort inner boot which has an at least partially extensible boot leg, on the outer face of which a plurality of wedging ele-ments are fixed, with the aim of obtaining a compromise between controlled compressibility of the thickness of the inner boot, which may vary from one zone to another, and transverse elastic extension of the boot leg, in order to allow passage of the foot without resorting to a tongue. Wedging elements made of different materials are used in order to obtain zones of different compressibility.

Patent CH 608,349 moreover proposes producing an inner boot essentially of expanded polyurethane, provided on its inner face with projections which come into direct contact with the foot and the ankle. The capacity for compression deformation and a variable distribution density of the projections over the surface of the inner boot makes it possible to create zones of different compressibility, with the aim of simultaneously providing comfort for the foot and good support of the latter, which is necessary for accurate control of the ski. The distribution of the projections has a higher density in the region of the malleoli, so as to obtain a greater deformation capacity. The projections therefore fulfill the function of a foam which would be substantially thicker in the region of the malleoli and other comfort zones, while it would be thin in the other zones.

The object of the present invention is to obtain, essentially by molding, an inner boot which best satisfies the above-mentioned requirements of anatomical shape, comfort and technical features.

In the inner boot according to the invention, the projections consist of studs, of which the height and at least one of the following parameters:

the mean cross section, the distribution density, the nature of the material vary according to the zone in question, in such a way that the boot leg has zones of different thickness and compressibility.

The studs of different heights make it possible to obtain a relief which matches the morphology of the foot of the skier.

The studs may be in direct contact with the foot, but the inner boot is preferably provided with an inner foam lining which covers the studs. The variable height and, optionally, the distribution density of the studs and/or their variable cross section in this case define a relatively large space which the foam can penetrate when it compresses, which also makes it possible to obtain zones having different characteristics as regards deformation capacity, capacity for recovering initial shape after compression has ceased, pressure reaction time, that is to say the time measured until maximum deformation, this reaction time being a determining factor in accuracy of control of the ski, and the capacity of matching the morphology, that is to say the capacity of deforming while still retaining a certain compressibility, which characteristic might be called adaptability.

SUMMARY OF THE INVENTION

In summary, the invention makes it possible to obtain an inner boot, the molded part of which, having variable thickness, adapts very well to the morphology of the foot and of the leg, good comfort and very good technical features because of the selective stiffness of the support zones which act as an interface.

BRIEF DESCRIPTION OF THE DRAWINGS

The attached drawing represents, by way of example, one embodiment of the invention.

DESCRIPTION OF THE PREFERRED EMBODIMENT

Figure 1:
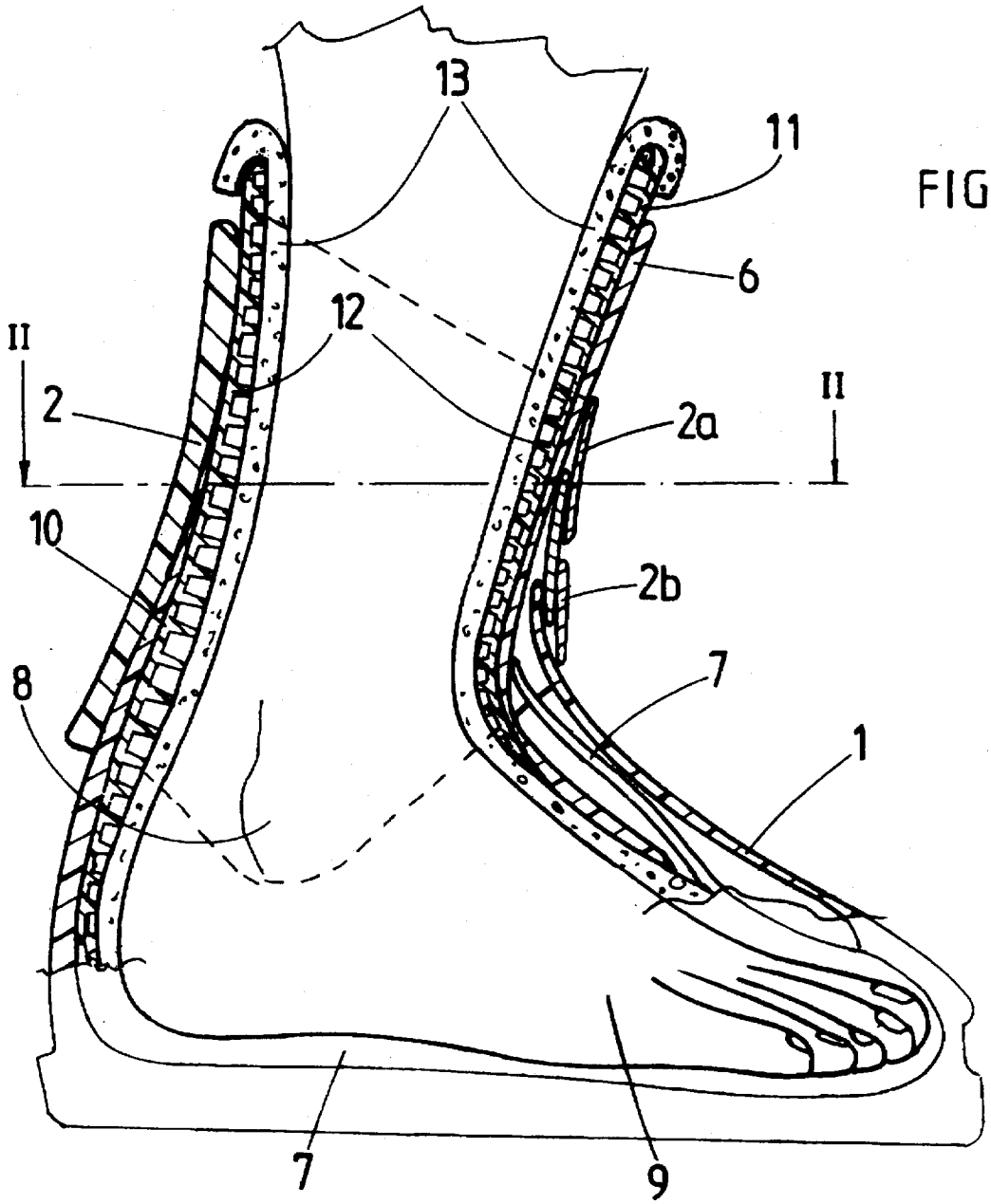
FIG. 1 is a view in section on I—I of FIG. 2, through a ski boot equipped with an inner boot according to the invention.
Figure 2:
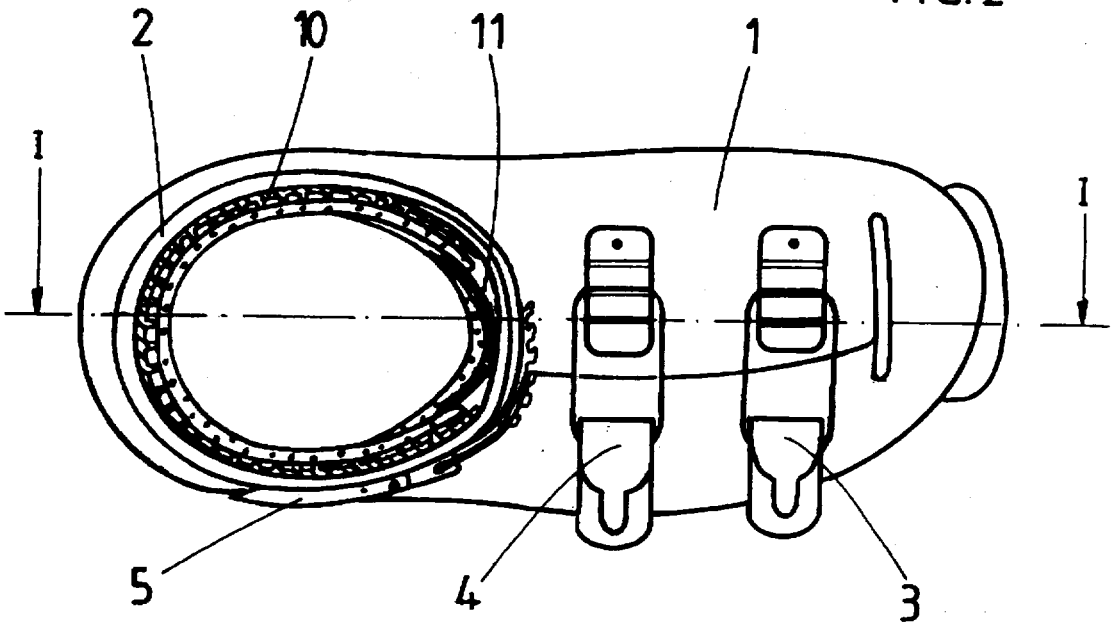
FIG. 2 is a cross-sectional view on II—II according to FIG. 1, showing the boot seen from above.

FIGS. 1 and 2 give a schematic representation of a ski boot consisting of a variable-volume shell 1 and a boot leg 2 in the form of a collar. The shell and the collar are, for example, made of polyurethane.

The shell 1 is provided with two tightening buckles 3 and 4. The same is true of the boot leg 2, of which one buckle 5 has been represented in FIG. 2. The buckles have not been represented in FIG. 1, but two flaps 2*a* and 2*b* of the collar 2 will be seen in this figure, the flaps being provided with buckles for closure and tightening of the collar.

Figure 3:
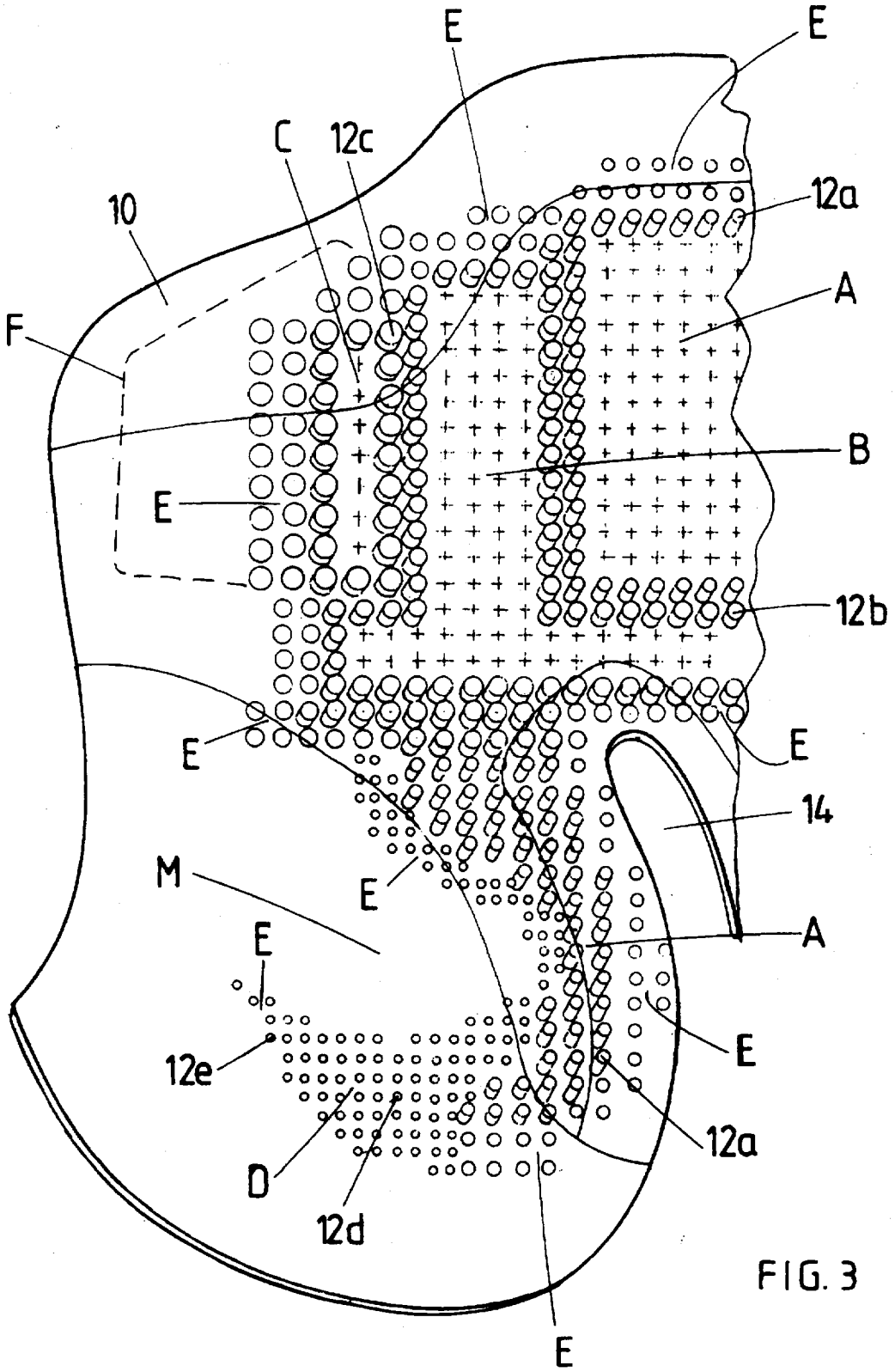
FIG. 3 is a developed view in cavalier projection, of half the plastic part, provided with studs, of the inner boot of the boot represented in FIGS. 1 and 2, that is to say an inner boot intended for the right foot.

The shell 1 and the boot leg 2 enclose a comfort inner boot comprising an upper 7 surrounding the front foot and the lower part of the heel, and extending below the malleolus 8 of the foot 9, and a boot leg essentially consisting of a plastic part 10 surrounding the rear of the leg and of the ankle and extending on each side of the leg and of the ankle, and a tongue 6 covering a part 11 made of the same material as the part 10. The parts 10 and 11 of the inner boot are provided with studs 12 pointing inward. As can be seen in FIG. 3, these studs 12, of slightly frustoconical shape, do not all have the same height and the same diameter and their distribution density varies according to the zones in question. The part 10 and the part 11, which is fixed on the tongue 6, are furthermore internally lined with a synthetic foam layer 13. FIG. 1 schematically illustrates the perfect matching of the internal shape of the inner boot to the shape of the foot and of the leg. As will be seen hereafter, this matching is produced without compression of sensitive zones and in a defined and controlled manner over the zones of the lower leg.

The variable height and mean diameter of the studs 12, as well as their distribution are seen clearly in the cavalier projection represented in FIG. 3. This figure represents the outer half of the part 10, that is to say the part extending over the outer side of the right foot. The other half is symmetrical, except as regards the deep cutout 14 which separates the inner and outer parts in the zone corresponding to the position of the Achilles' tendon. This cutout 14 does not extend along the axis of symmetry of the part 10, but moves away from this axis of symmetry toward the outer side of the foot.

The studs 12 are integrally molded with their support 10 and have a frustoconical shape. The plastic used is, for example, polyurethane.

Distinction is made between three different types of zone, denoted A, B, C, D and E. The upper zone A, as well as the zones B and C have been represented only by the marginal studs in these zones.

The studs 12*a* in the zones A have a mean diameter of 3 mm, a height of 4 mm and a pitch (interaxial spacing) of 6 mm.

The studs 12*b* in zone B have a mean diameter of 4 mm, a height of 3 mm and a pitch of 6 mm.

The studs 12*c* in zone C have a mean diameter of 5 mm, a height of 2 mm and a pitch of 7 mm.

The studs 12*d* in zone D have a mean diameter of 2 mm, a height of 3 mm and a pitch of 4 mm.

The zones E are marginal transition zones which have studs with the same diameter and the same pitch as the neighbouring zone, but with decreasing height.

Because of the different height of the studs according to the zones in question, the part 10 behaves as a variable-thickness piece, and more precisely as a piece whose inner face has a variable-height relief. In particular, the studs 12 define a depression M corresponding to the position of the malleolus. The latter can therefore be accommodated in this depression M. Similarly, the transition zones E adjacent the cutout 14 form a housing for the Achilles' tendon. In general, the relief formed by the studs 12 matches the part 10 to the morphology of the lower leg.

When the foam 13 covering the studs 12 is compressed, the parts of this foam which do not bear on the studs penetrate the spaces located between the studs and undergo deformation which varies from zero at the center to a maximum value equal to the compression which the studs undergo. The degree of penetration of the foam between the studs depends on the volume of the space between the studs, that is to say on the height, diameter and distribution density of the studs. The degree of penetration of the foam contributes to giving the inner boot a particular behaviour in compression.

By varying the parameters of diameter, height and pitch of the studs 12, it is possible to obtain zones having a deformation capacity, a pressure reaction time and adaptability to the morphology of the foot which vary from one zone to another. More precisely, the higher the studs, the greater the capacity of the inner boot to deform; the larger their diameter, the shorter the reaction time of the inner boot; the smaller the pitch, the greater the adaptability of the inner boot.

As a consequence, the zones A are zones which have a relatively high deformation capacity. These are comfortable support zones. This is the case, in particular, of the posterior support zone A for supporting the bottom of the calf. On the other hand, the zones C are zones with a short reaction time, having little capacity for deformation and poor adaptability to morphology. The zones C are therefore much more capable of transmitting the pressures involved in guiding the ski. The zone B is a zone which has characteristics that are intermediate between those of the zones A and those of the zones C.

According to an alternative embodiment, it is possible to provide additional zones F, consisting of studs which have a diameter of 3 mm, a height of 0.2 mm and a pitch of 6 mm.

The current techniques termed double or multiple injection, make it possible to obtain plastic pieces consisting of different materials. According tO an alternative embodiment of the invention, which applies this technique, at least a portion of these studs is made of one or more materials with a stiffness different than that of the material forming the support of the studs. It is thus possible to obtain zones with different compressibilities simply by choosing a suitable material. In this case, the studs can therefore have a uniform cross section and distribution density. The part 10 supporting the studs may itself be made of a single material or a plurality of different materials.

The effect obtained by the nonuniformity of the studs could be further amplified by the use of foams with different densities according to the zones.

The inner boot might not include foam 13, the studs 12 then being in direct contact with the foot or simply covered with a woven material or a felt. In this case, benefit would still be gained from the special structure of the inner boot, that is to say from the inner relief which matches the morphology of the foot, the capacity, varying from one zone to another, for deformation and matching to the morphology of the foot by deformation.

The frustoconical shape of the studs is dictated by practical reasons of release from the mold. In principle, the studs could have a cylindrical shape, or even a noncircular cross section. The end of the studs could be domed.

I claim:

1. A ski boot for a ski and skier having a lower leg and foot having a morphology, the ski boot comprising a shell (1) and boot leg (2, 6), a comfort inner boot within the ski boot for matching of the shell to the shape of the foot, and provides thermal insulation, comfort and function interface between the shell and the foot for transmission of information and control between a ski and the foot, the inner boot comprising an inner boot parts (10, 11) for surrounding the foot and the lower leg of the skier at least partially, the inner boot part having an inner face provided with inwardly projecting studs (12) for projecting toward the foot and lower leg of the skier and distributed over at least a part of its surface, the inner boot being internally lined with a foam directly in contact with the studs, the studs (12) possessing a height and at least one of the following parameters:

a mean cross section, a distribution density, a nature of the material which vary in such a way that the inner boot has zones of different thickness and compressibility, by varying the parameters of diameter, height and pitch of the studs, it is possible to obtain zones having properties possessing a predetermined deformation capacity, a predetermined pressure reaction time and adaptability to the morphology of the foot which properties vary from one zone to another, the studs being of different heights make it possible to obtain a relief which matches the morphology of the foot of the skier, the distribution density of the studs and cross section define a space in which foam can penetrate when it compresses, which also makes it possible to obtain zones having different characteristics as regards deformation capacity, capacity for recovering initial shape after compression has ceased, pressure reaction time which is a determining factor in accuracy of control of the ski, and the capacity of matching and adapting to the morphology, the higher the studs, the greater the capacity of the inner boot to deform, the larger the stud diameter, the shorter the reaction time of the inner boot, the smaller the pitch, the greater the adaptability of the inner boot.

2. The ski boot as claimed in claim 1, wherein the studs are integrally molded with the inner boot part.

3. The ski boot according to claim 2, wherein the studs are of frustoconical shape.

4. The ski boot as claimed in claim 3, wherein the studs have a different mean diameter according to the zone in question.

5. The ski boot as claimed in claim 4, wherein the region of the inner boot corresponding to the position of the malleoli has studs of decreasing height surrounding a zone (M) which is free of studs, which zone corresponds to the location of the malleoli.

6. The ski boot as claimed in claim 5, wherein the upper zone of the back of the inner boot has a support and comfort zone (A) which is relatively more compressible than the lower zone (B) of the back and than the lateral zones (B).

7. The ski boot as claimed in claim 1, in which the material of the studs varies from zone to zone wherein the material supporting the studs also varies from zone to zone.

8. The inner boot as claimed in claim 1, in which the material of the studs varies from zone to zone, wherein the material supporting the studs is uniform.

9. The ski boot as claimed in claim 1, wherein the foam has a variable density according to the zones in question.

10. The ski boot as claimed in claim 1, wherein the inner boot is provided with a tongue (6) fixed to the inner boot parts, the inner face of which is also provided with studs (12).

11. The ski boot as claimed in claim 1, wherein when the foam covering the studs having a center is compressed, the parts of this foam which do not bear on the studs penetrate the spaces located between the studs and undergo deformation which varies from zero at the center to a maximum value equal to the compression which the studs undergo, the degree of penetration of the foam between the studs depends on the volume of the space between the studs, on the height, diameter and distribution density of the studs, the degree of penetration of the foam contributing to giving the inner boot a particular behavior in compression.

* * * * *